US010883296B2

(12) United States Patent
Han et al.

(10) Patent No.: US 10,883,296 B2
(45) Date of Patent: Jan. 5, 2021

(54) WASHING MACHINE

(71) Applicant: Samsung Electronics Co., Ltd., Suwon-si (KR)

(72) Inventors: Won Jae Han, Seoul (KR); Young-Hyun Kim, Suwon-si (KR); Do haeng Kim, Suwon-si (KR); Min Hwan Oh, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

(21) Appl. No.: 16/314,191

(22) PCT Filed: Jun. 30, 2017

(86) PCT No.: PCT/KR2017/006954
§ 371 (c)(1),
(2) Date: Dec. 28, 2018

(87) PCT Pub. No.: WO2018/004295
PCT Pub. Date: Jan. 4, 2018

(65) Prior Publication Data

US 2019/0249349 A1 Aug. 15, 2019

(30) Foreign Application Priority Data

Jun. 30, 2017 (KR) ..... 10-2017-0083142

(51) Int. Cl.
*E05D 3/12* (2006.01)
*E05F 1/12* (2006.01)
*E05F 3/20* (2006.01)

(52) U.S. Cl.
CPC ..... *E05F 1/1261* (2013.01); *E05F 3/20* (2013.01); *E05Y 2201/638* (2013.01); *E05Y 2900/312* (2013.01)

(58) Field of Classification Search
CPC ..... E05Y 2201/638; E05Y 2900/312; E05F 1/1261; E05F 3/20
See application file for complete search history.

(56) References Cited

U.S. PATENT DOCUMENTS 3,204,287 A * 9/1965 Gronbach ..... E05F 1/1261 16/288
4,091,502 A * 5/1978 Little ..... E05D 11/1064 16/273

(Continued)

FOREIGN PATENT DOCUMENTS

JP 9-131495 5/1997
KR 10-0744968 8/2007

(Continued)

OTHER PUBLICATIONS

International Search Report dated Sep. 20, 2017 in corresponding International Application No. PCT/KR2017/006954.

(Continued)

*Primary Examiner* — Matthew W Ing
(74) *Attorney, Agent, or Firm* — Staas & Halsey LLP

(57) ABSTRACT

A washing machine comprises a hinge device including a cam member, a lever, and an elastic member, and the cam member comprises an outer circumference surface including a first section, a second section and a third section disposed between the first section and the second section having a curvature different from each other. The cam member is profiled to be disposed at a first position in which the door is automatically opened, a second position in which the door is automatically closed, and at a third position in which an external resultant force becomes 0 (zero), when the lever is in contact with each section. Therefore, it is possible to control a closing speed of the door and simplify the power transmission method by using the cam, reduce the material (Continued)

cost by reducing the number of parts, and secure the reliability of driving of the washing machine.

14 Claims, 24 Drawing Sheets

(56) References Cited

U.S. PATENT DOCUMENTS

| | | | | |
|---|---|---|---|---|
| 2014/0109344 | A1* | 4/2014 | Lee | E05D 3/12 16/304 |
| 2014/0130302 | A1* | 5/2014 | Bettinzoli | E05F 1/1261 16/304 |
| 2014/0150212 | A1* | 6/2014 | Collene | E05F 1/1261 16/286 |
| 2017/0130502 | A1* | 5/2017 | Collene | D06F 39/14 |

FOREIGN PATENT DOCUMENTS

| | | |
|---|---|---|
| KR | 10-1255516 | 4/2013 |
| KR | 10-1527416 | 6/2015 |
| KR | 10-1708633 | 2/2017 |

OTHER PUBLICATIONS

Written Opinion of the International Searching Authority dated Sep. 20, 2017 in corresponding International Application No. PCT/KR2017/006954.

* cited by examiner

WASHING MACHINE

CROSS-REFERENCE TO RELATED APPLICATIONS

This application is a National Phase application which claims the benefit under 35 U.S.C. § 371 of International Patent Application No. PCT/KR2017/006954 filed Jun. 30, 2017 which claims the foreign priority benefit under 35 U.S.C. § 119 of Korean Patent Application No. 10-2016-0082780, filed Jun. 30, 2016 and Korean Patent Application No. 10-2017-0083142, filed Jun. 30, 2017, the disclosures of which are incorporated herein by reference.

TECHNICAL FIELD

The present disclosure relates to a washing machine, and more particularly, to a door hinge of a washing machine.

BACKGROUND ART

Generally, a washing machine is an apparatus for washing laundry by performing washing, rinsing, dewatering and drying.

Washing machines are classified into a pulsator type in which a rotary plate having small blades is disposed on a lower side of a washing tub and rotated to generate water stream, thereby washing laundry, an agitator type in which a large agitator having blades is disposed in the center of a washing tub and alternately rotated to generate water stream at a regular interval, thereby washing laundry, and a drum type in which laundry is placed inside of a drum, thereby washing laundry by using an impact caused by a rotation of the drum, and detergency of a detergent.

In the pulsator type, a door of a washing machine is disposed on the upper side to open and close an upper portion of the washing machine. When the door moves downward in a closing operation of the door, the door can be closed quickly due to gravity caused by the self-weight of the door. A noise caused by the impact may occur or a safety accident in which the user's hand is caught in the door may occur.

DISCLOSURE

Technical Problem

The present disclosure is directed to providing a washing machine having a hinge unit having a simple power transmission system upon opening and closing a door of the washing machine.

The present disclosure is directed to providing a washing machine having a hinge unit capable of controlling an opening and closing speed of a door.

Technical Solution

One aspect of the present disclosure provides a washing machine including a cabinet, a door configured to be rotatable about the cabinet and configured to open and close one side of the cabinet, a cam member configured to be rotated by the door and provided with a curved surface comprising a first section, a second section and a third section disposed between the first section and the second section having a curvature different from each other, a lever configured to press the cam member by being in contact with the curved surface of the cam member, and an elastic member configured to elastically support the lever.

The door may be rotated in a direction, in which the door is opened, when the lever is in contact with the first section.

The door may be rotated in a direction, in which the door is closed, when the lever is in contact with the second section.

The door may be in a stop state when the lever is in contact with the third section.

When an angle, at which the door is in a closed state, is 0 (zero), the angle of the door may be between 75 and 100 degrees when the lever is in contact with the first section.

When an angle, at which the door is in a closed state, is 0 (zero), the angle of the door may be between 0 and 35 degrees when the lever is in contact with the second section.

When an angle, at which the door is in a closed state, is 0 (zero), the angle of the door may be between 25 and 85 degrees when the lever is in contact with the third section.

The washing machine may further include a housing comprising a shaft inserted into the door to form a rotation axis of the door and coupled to the cam member, and an inner space in which the cam member, the lever and the elastic member are placed, and the elastic member may be elastically deformed between one side of the inside of the housing and one side of the lever, and the lever may be linearly moved inside of the housing by the elastic member and may directly press the cam member by the linear movement.

The washing machine may further include a damper disposed on one side of the lever and inserted into the inside of the elastic member.

The damper may start a contact with one side of the housing when the lever is in contact with the third section, and the damper may dampen the linear movement of the lever by being in contact with one side of the housing when the lever is sequentially in contact with the third section and the second section due to a rotation of the cam member.

The damper may include a damper housing, a cylinder provided inside of the damper housing, and a rod configured to perform a transitional motion inside of the cylinder, and the damper housing may be integrally formed with the lever.

A curvature contained in the third section may be greater than a curvature contained in the first section or a curvature contained in the second section.

A curvature contained in the first section may be less than a curvature contained in the second section or a curvature contained in the third section.

The third section may include a fourth section concave in a rotation axis of the cam member.

Another aspect of the present disclosure provides a washing machine including a cabinet, a door configured to open and close the cabinet, a lever disposed to be linearly moved, an elastic member configured to elastically bias the lever, and a cam member configured to pivot around a cam rotation axis according to a rotation of the door and provided with a curved surface having a contact portion in contact with the lever. The curved surface is profiled such that a position of the contact portion is changed according to a rotation position of the door.

When an angle, at which the door closes the cabinet, is 0 (zero), the cam member may be profiled such that a distance between the rotation axis of the cam member and the contact portion of the cam member in contact with the lever becomes shorter as an opening angle of the door becomes larger.

The cam member may further include a first section, in which the contact portion is positioned when an opening angle of the door is between 75 and 100 degrees, and the cam member may be profiled to be rotated in the opening direction of the door when the contact portion is on the first section.

The cam member may further include a second section, in which the contact portion is positioned when an opening angle of the door is between 0 and 35 degrees, and the cam member may be profiled to be rotated in a closing direction of the door when the contact portion is on the second section.

The cam member may further include a third section, in which the contact portion is positioned when an opening angle of the door is between 25 and 85 degrees, and the cam member may be profiled such that the door is maintained in a stop state when the contact portion is in the third section.

When a rotational force applied to the cam member by the lever is referred to as a first torque and a rotational force applied to the cam member by a self-weight of the door is referred to as a second torque, the cam member may be profiled such that, when the contact portion is placed in the second section, a magnitude of the first torque may be less than a magnitude of the second torque as the contact portion is moved.

Advantageous Effects

It is possible to reduce a closing speed of a door by using multiple cam member profiling, and simplify the power transmission method by using the cam, and thus it is possible to reduce the material cost by reducing the number of parts and secure the reliability of the driving of the washing machine.

MODES FOR THE INVENTION

Figure 1:
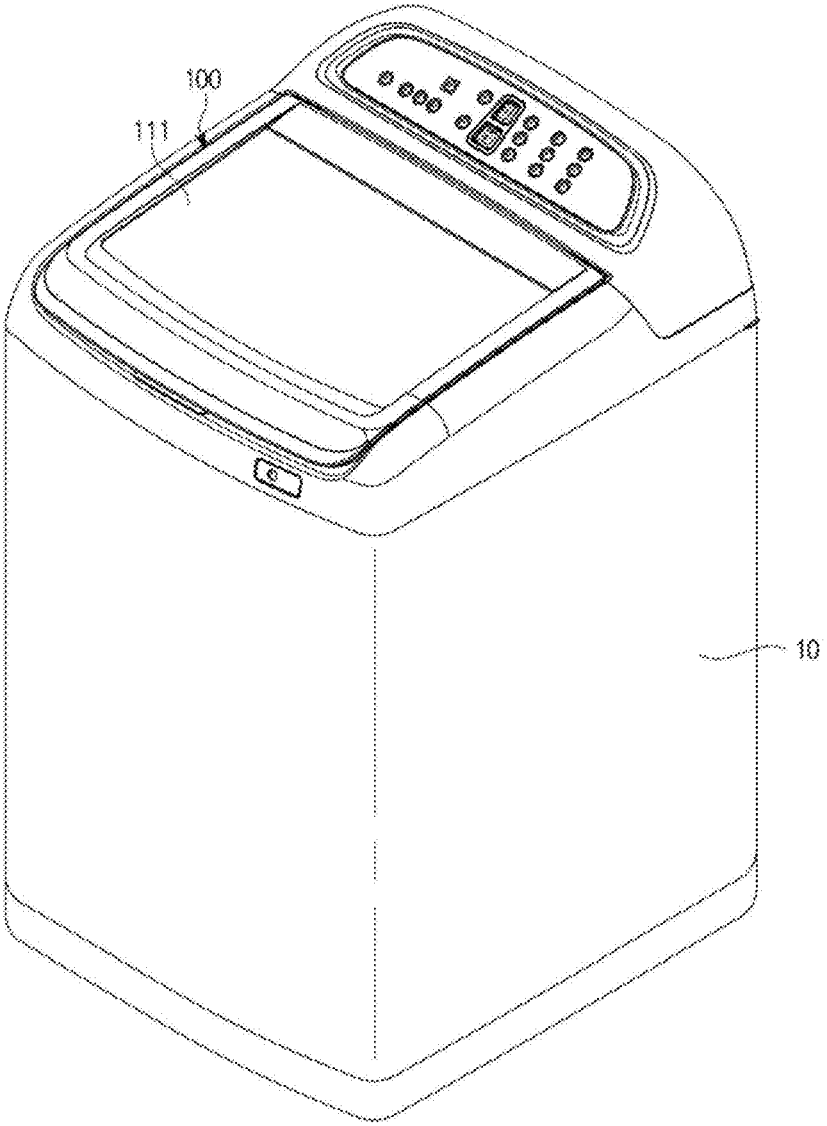
FIG. 1 is a perspective view of a washing machine according to one embodiment of the present disclosure.

Embodiments described in the present disclosure and configurations shown in the drawings are merely examples of the embodiments of the present disclosure, and may be modified in various different ways at the time of filing of the present application to replace the embodiments and drawings of the present disclosure.

In addition, the same reference numerals or signs shown in the drawings of the present disclosure indicate elements or components performing substantially the same function.

Also, the terms used herein are used to describe the embodiments and are not intended to limit and/or restrict the present disclosure. The singular forms "a," "an" and "the" are intended to include the plural forms as well, unless the context clearly indicates otherwise. In this present disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the present disclosure, a first element may be termed as a second element, and a second element may be termed as a first element. The term of "and/or" includes a plurality of combinations of relevant items or any one item among a plurality of relevant items.

Terms 'upper side', 'upper', 'lower side' and 'lower' is defined by an upper and lower direction of a washing apparatus of FIG. 1 according to one embodiment, and thus an upper side of a body of the washing apparatus of FIG. 1 is referred to as an upper side, and a lower side thereof is referred to as a lower side.

In terms 'front side', 'rear side', 'front surface side', and 'rear surface side', a side in which a door of the washing apparatus of FIG. 1 is referred to as a front side and an opposite side thereof is referred to as a rear side.

The left side of the front side is referred to as a 'left side' and the right side is referred to as a 'right side' with reference to the washing machine direction in FIG. 1.

Also, it is apparent that the washing machine according to the present disclosure can be applied not only to a washing machine including an auxiliary washing space, but also to a general washing machine that does not include an auxiliary washing space.

Hereinafter exemplary embodiments of the present disclosure will be described in detail with reference to the accompanying drawings.

Figure 2:
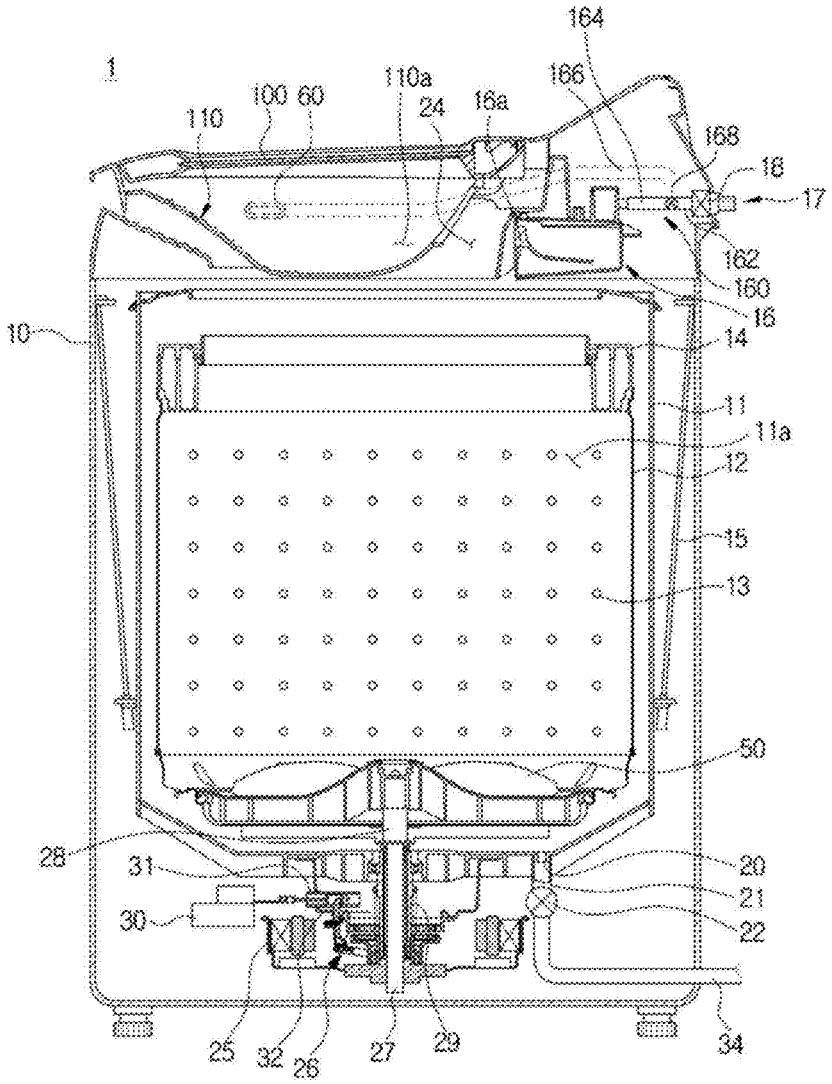
FIG. 2 is a side cross-sectional view of the washing machine according to one embodiment of the present disclosure.

As shown in FIGS. 1 and 2, a washing machine 1 includes a cabinet 10 forming an exterior, a stationary tub 11 disposed inside of the cabinet 10 and configured to store washing water, a rotary tub 12 rotatably disposed inside of the stationary tub 11, and a pulsator 50 disposed inside of the rotary tub 12 to generate a water stream.

An opening 24 is formed in the upper portion of the cabinet 10 to allow laundry to be introduced into the rotary tub 12. The opening 24 may be opened or closed by a door 100 installed on an upper portion of the cabinet 10. The stationary tub 11 may be supported by a suspension 15 in the cabinet 10.

In an upper portion of the stationary tub 11, a water supply pipe 17 supplying washing water to the stationary tub 11 is installed. One side of the water supply pipe 17 is connected to an external water supply source, and the other side of the water supply pipe 17 is connected to a detergent supply device 16. The water supplied through the water supply pipe 17 is supplied to the inside of the stationary tub 11 together with the detergent via the detergent supply device 16. A water supply valve 18 is provided in the water supply pipe 17 to control the supply of water.

The rotary tub 12 is provided in a cylindrical shape with an open top, and a plurality of discharging holes 13 is formed on the side thereof. A balancer 14 may be mounted on the upper portion of the rotary tub 12 to stably rotate the rotary tub 12 at a high-speed rotation.

A motor 25 generating a driving force to rotate the rotary tub 12 and pulsator 50, and a power switching device 26 simultaneously or selectively transmitting a driving force generated by the motor 25 to the rotary tub 12 and the pulsator 50 are provided in the outside of the lower side of the stationary tub 11.

A hollow dewatering shaft 29 is coupled to the rotary tub 12 and a washing shaft 27 provided in the hollow portion of the dewatering shaft 29 is coupled to the pulsator 50 through a washing shaft coupling portion 28. The motor 25 may simultaneously or selectively transmit the driving force to the rotary tub 12 and pulsator 50 in accordance with the ascending and descending operations of the power switching device 26.

The power switching device 26 may include an actuator 30 generating a driving force for power switching, a rod 31 linearly moving in accordance with the operation of the actuator 30, and a clutch 32 rotating in accordance with the operation of the rod 31 by being connected to the rod 31.

A discharge port 20 is formed on the bottom of the stationary tub 11 to discharge the washing water stored in the stationary tub 11, and a first drain pipe 21 is connected to the discharge port 20. The first drain pipe 21 may be provided with a drain valve 22 controlling drainage. An outlet of the drain valve 22 may be connected to a second drain pipe 34 discharging the washing water to the outside.

The door 100 and an auxiliary washing unit 110 provided on the lower side of the door are provided in the opening 24. The door 100 is provided at one side of the cabinet 10 and configured to open and close the opening 24. The door 100 may be provided with a transparent member 110 to allow the door 100 to be shown even when the opening 24 is closed.

The auxiliary washing unit 110 is provided with an auxiliary washing space 110*a* to allow a user to perform an additional washing manually. The auxiliary washing space 110*a* is separated from a main washing space 11*a* formed by the stationary tub and the rotary tub so as to allow a user to perform washing.

The main washing space 11*a* and the auxiliary washing space 110*a* are separated from each other to allow washing to be performed independently of each other. In addition, the washing in the main washing space 11*a* and the auxiliary washing space 110*a* may be performed separately or simultaneously.

The auxiliary washing unit 110 may be provided to be rotatable with respect to one side of the inside of the door 100. The auxiliary washing unit 110 may be provided with the same axis so as to coincide with a rotation axis of the door 100.

The main washing space 11*a* and the auxiliary washing space 120*a* may include a water supplier 160 to supply water.

The water supplier 160 may include a water supply pipe 162, a main water supply pipe 164, an auxiliary water supply pipe 166 and a switching unit 168.

One end of the water supply pipe 162 may be connected to the water supply valve 18 and the other end may be connected to the switching unit 168. The water supply pipe 162 may transmit the washing water supplied from the water supply valve 18 to the switching unit 168.

A main water supply pipe 164 may be provided to supply water to the main washing space 11*a*. One end of the main water supply pipe 164 may be connected to the detergent supply device 16 and the other end of the main water supply pipe 164 may be connected to the switching unit 168.

An auxiliary water supply pipe 166 may be provided to supply water to the auxiliary washing space 110*a* of the auxiliary washing unit 110. One end of the auxiliary water pipe 166 may be connected to an auxiliary water supply port 60 and the other thereof may be connected to the switching unit 168.

The switching unit 168 is configured to selectively supply washing water delivered from the water supply pipe 162 to one of the main water supply pipe 164 and the auxiliary water supply pipe 166. That is, the washing water is supplied to the washing space through at least one of the main water supply pipe 164 and the auxiliary water supply pipe 166 under the control of the switching unit 168.

Hereinafter a hinge unit 200 opening and closing the door 100 will be described in detail.

Figure 3:
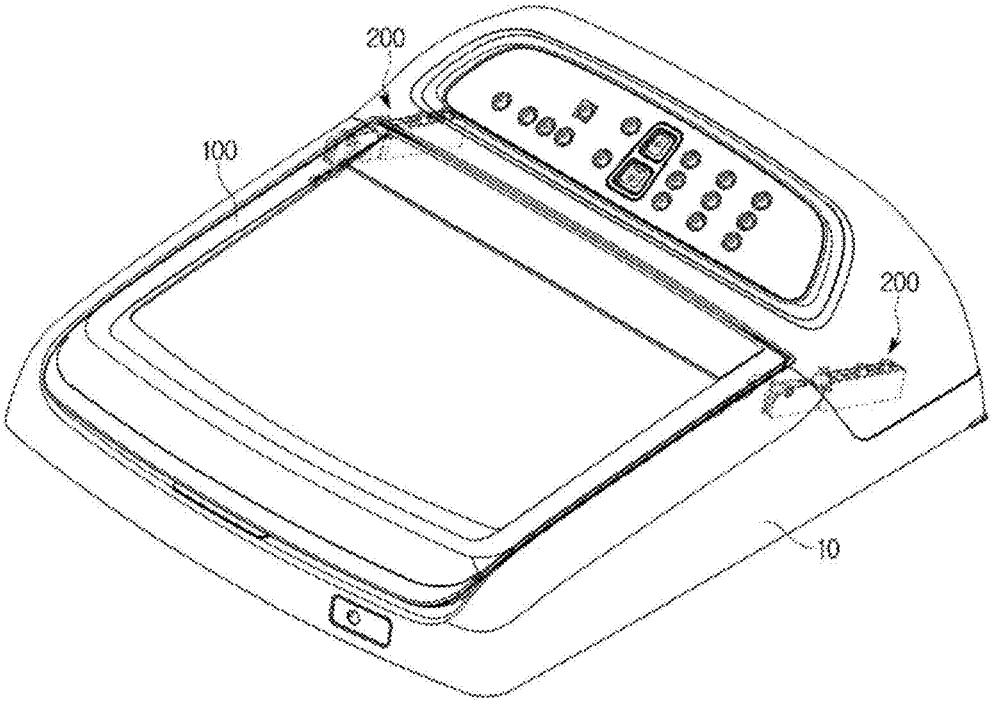
FIG. 3 is a perspective view of some components of the washing machine according to one embodiment of the present disclosure.
Figure 4:
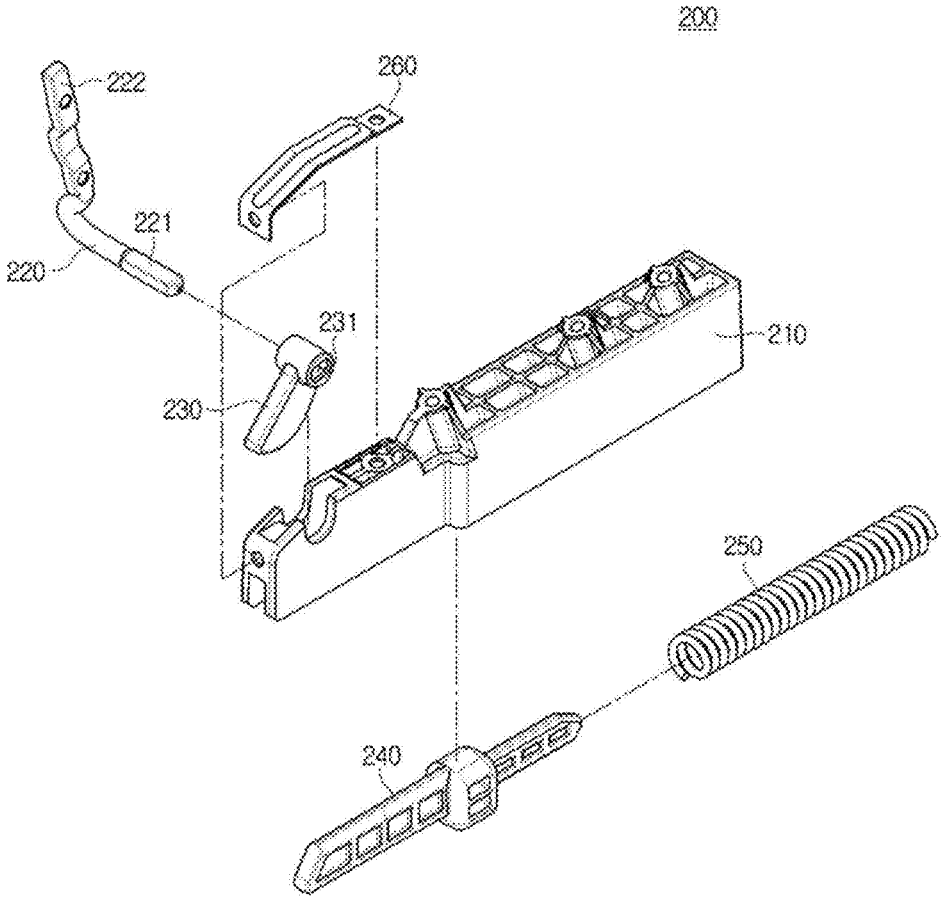
FIG. 4 is an exploded perspective view of a hinge unit of the washing machine according to one embodiment of the present disclosure.
Figure 5:
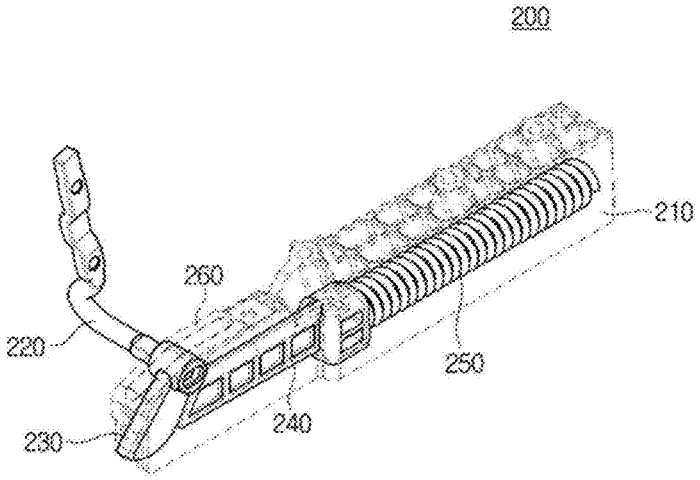
FIG. 5 is a view showing a part of the hinge unit of the washing machine according to one embodiment of the present disclosure.

As illustrated in FIGS. 3 to 5, the hinge unit 200 may be disposed on opposite sides of the door 100 to allow the door 100 to be rotatable about the opening 24. The hinge unit 200 disposed on opposite sides are symmetrical to each other. Hereinafter one hinge unit 200 disposed on the right side of the door 100 will be described with reference to FIG. 2.

The hinge unit 200 may include a housing 210, a shaft 220 inserted into the door 100 to rotate the door 100, a cam member 230 coupled to the shaft 220 to be rotated in accordance with a rotation of the door 100, a lever 240 configured to press the cam member 230 and an elastic member 250 configured to elastically support the lever 240.

The housing 210 may include a first chamber 211 in which the elastic member 250 is compressed and extended and the lever 240 linearly reciprocates, and a second chamber 213 in which the cam member 230 is rotated. The first chamber 211 and the second chamber 213 are provided on the inner side of the housing 210, and may be defined as a space in which each of the above-described configuration are disposed. The lower side of the first chamber 211 and the second chamber 213 may be open and thus the lever 240 and the elastic member 250 may be assembled inside the housing 210. A part of an upper portion of the second chamber 213 may be open and thus the cam member 230 and the shaft 220 may be assembled inside of the housing 210 through the upper side.

A support surface 212 supporting one end of the elastic member 250 may be provided at one side of the first chamber 211. One end of the elastic member 250 is supported on the support surface 212 and thus the elastic member 250 may be compressed when the lever 240 is linearly moved in conjunction with the rotation of the cam member 230.

The shaft 220 may include a shaft portion 221 configured to form a rotation axis of the door 100 and coupled to the cam member 230, and an insertion portion 222 extended from the shaft portion 221 and then bent to be inserted into the door 100.

The shaft portion 221 is rotated in a direction, in which the door 100 is rotated, according to the rotation of the door 100 and thus the rotational force of the door 100 may be transmitted to the cam member 230. In other words, the door 100 and the cam member 230 may be rotated around the shaft portion 221 since the rotation axis of the door 100 and the rotation axis of the cam member 230 are provided on the shaft portion 221.

The insertion portion 222 may be bent at an angle substantially orthogonal to the shaft portion 221 and inserted into the door 100. The insertion portion 222 may be rotated together with the door 100 around the shaft portion 221.

When an angle of the inserting portion 222 with respect to the shaft portion 221 is 0 (zero) degree during the door 100 is in the closed state, the angle of the inserting portion 222 may be identical to an angle in which the door 100 is disposed in the vertical direction with respect to the opening.

The cam member 230 may include an insertion port 231 into which the shaft portion 221 is inserted. The shaft portion 221 may be inserted into the insertion hole 231 and coupled with the cap member 230. Accordingly, according to the rotation of the shaft portion 221, the cam member 230 may be rotated in conjunction with the door 100 clockwise or counterclockwise.

The cam member 230 may include a curved surface 232 formed on the outer side. A contact section 233, with which the lever 240 is in contact to transmit a force of the lever 240 to the cam member 230, may be provided at one side of the curved surface 232. The contact section 233 will be described later in detail.

The contact section 233 may be disposed on an outer circumferential surface of the cam member 230 of the curved surface 232, but is not limited thereto. Alternatively, the contact section 233 may be formed at a position that is disposed on the outer side of the cam member 230 to be in contact with the lever 240.

The lever 240 may have one side that is elastically supported by the elastic member 250 and the other side that presses the cam member 230 by the elastic force of the elastic member 250, as described above. On one side of the lever 240, a guide portion 241 and a support 242 may be provided. The guide portion 241 may be inserted into the inside of the elastic member 250 to guide the translational compression and extension of the elastic member 250, and the support 242 may support the other end of the elastic member 250 to transmit the elastic force of the member 250 to the lever 240.

On the other side of the lever 240, a body 243 extending from the support 242 may be provided. The body 243 may include a pressing portion 244 pressing the cam member 230 by being in contact with an outer peripheral surface 232 of the cam member 230.

Figure 6:
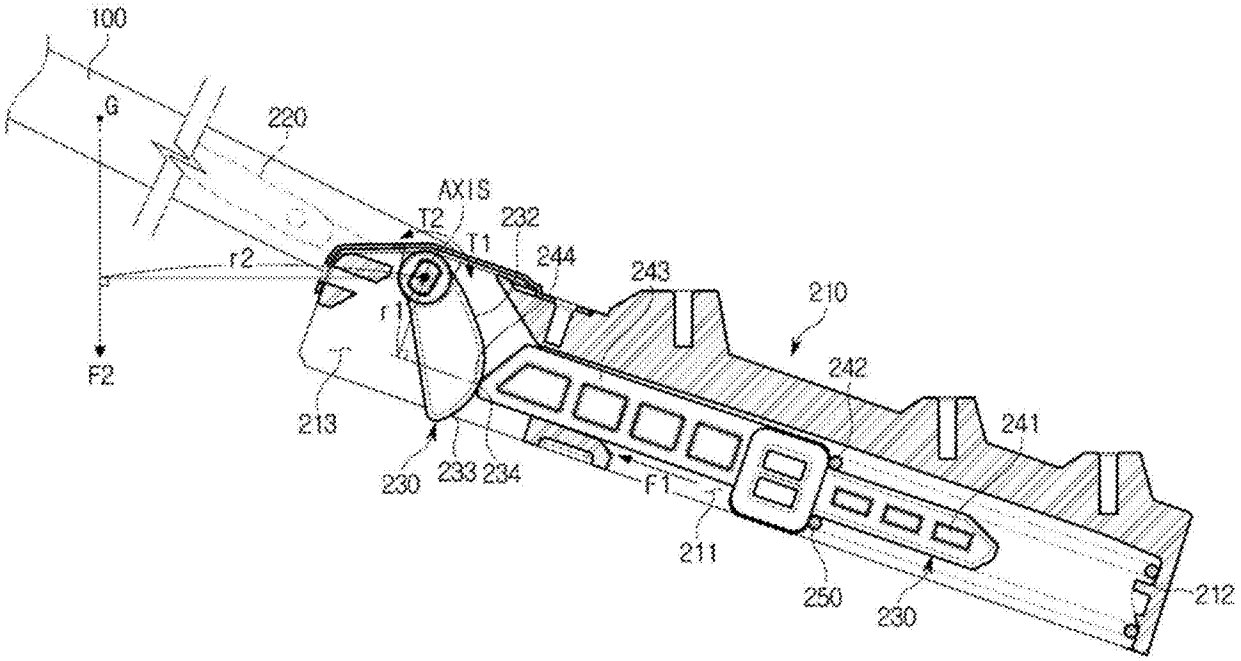
FIG. 6 is a schematic view showing a part of the hinge unit and a door of the washing machine according to one embodiment of the present disclosure.

Referring to FIG. 6, as the door 100 rotates counterclockwise (the direction in which the door 100 is closed), the compressive force transmitted to the support 242 may be increased since the elastic member 250 is compressed.

Accordingly, the pressing portion 244 may apply a greater force to the pressing section 233 as the door 100 more rotates in the closing direction. This will be described later in detail with the contact section 233 described above.

As described above, an opening may be formed on the upper portion of the second chamber 213 of the housing 210 to assemble the cam member 230 and the shaft 220. In the opening, a cap member 260 configured to close the opening after the cam member 230 and the shaft 220 are assembled with the housing 210 may be provided.

Hereinafter a torque applied to the cam member 230 will be described. For convenience of description, a direction in which the door 100 is opened is defined as a clockwise direction of the rotation axis, and a direction in which the door is closed is defined as a counterclockwise direction of the rotation axis, with respect to FIG. 6.

As illustrated in FIG. 6, a first torque T1 generated by the pressure of the lever 240 and a second torque T2 generated by a self-weight of the door 100 may be applied to the cam member 230.

The first torque T1 may transmit a force, which rotates in the clockwise direction of the rotation axis, to the cam member 230 by the compression force of the elastic member 250 which is arranged to be inclined with respect to the vertical direction. When the force transmitted to the lever 240 by the compression force of the elastic member 250 is defined as F1 and a vertical distance between F1 and the rotation axis is defined as r1, a magnitude of the first torque T1 may be obtained as F1*r1.

However, when the pressing portion 244 presses the cam member 230, the direction in which the force is formed may be changed along a tangential direction of the contact section 233 and thus a length of r1 may be practically changed. Therefore, for convenience of description, the first torque T1 is described, when it is assumed that F1 is directed toward the compression direction of the elastic member 250 and thus r1 is kept constant.

The second torque T2 may transmit a force that rotates in the counterclockwise direction of the rotation axis, to the cam member 230 by the force F2 of gravitational acceleration generated at the center of gravity G of the door 100. That is, the force that rotates in the counterclockwise direction of the rotation axis may be transmitted to the cam member 230 by F2. Therefore, the second torque T2 may be obtained by multiplying a vertical distance r2 from the center of gravity G of the door 100 to the rotational axis by the self-weight of the door 100.

The first torque T1 and the second torque T2 are transmitted to the cam member 230 in the opposite direction and thus the cam member 230 may be rotated in a direction to which a greater force between the first torque T1 and the second torque T2 is applied.

Hereinafter the contact section 233 of the cam member 230, and the pressing portion 244 of the lever 240 pressing the cam member 230 by being in contact with the contact section 233, and a contact portion 234 formed on the contact section 233 by the pressing portion 244 will be described in detail.

In the case of the pulsator type washing machine as in one embodiment of the present disclosure, the door 100 is disposed on the upper side of the cabinet 10 and thus it is possible to open the opening 24 by rotating the door 100 upward and to close the opening 24 by rotating the door 100 downward.

The door 100 is rotated downward about the rotation axis in the operation of closing the door 100. Therefore, when the door 100 is heavy, the door 100 is quickly closed due to gravity. At this time, there is a risk of safety accident that the user's finger is caught between the cabinet 10 and the door 100, and when the door 100 is quickly closed, the door 100 strongly collides with the cabinet 10, thereby generating a loud noise.

In order to relieve this problem, a conventional washing machines controls an opening and closing operation of a door by convert a rotary motion of a pin, which is fastened to a door, into a translational motion via a link structure and by using an impact generated in the process as stiffness of a spring, or controls a closing speed of the door by installing an additional hydraulic cylinder.

This technology provides a stable result, but it causes an increase in the material cost because of the increase of the number of parts and complexity of the assembly structure due to the link structure.

In such a conventional washing machine, an additional member controlling a closing speed of the door is provided in the hinge unit, and thus the volume of the hinge unit is increased, thereby increasing the size of the cabinet or decreasing the size of the stationary tub provided inside the cabinet. In addition, as the additional structure such as the link structure is increased, the assembly structure becomes complicated and the manufacturing cost increases.

To relieve this difficulty, according to one embodiment, the hinge unit 200 includes the cam member 230, and the elastic member 250 and the lever 240 supporting the cam member 230. Therefore, it is possible to simplify the power transmission method of the hinge unit 200 to ensure reliability and to reduce the manufacturing cost by reducing the number of parts due to the reduction of the configuration. In addition, it is possible to solve the safety problem of the user and prevent noise generation.

That is, since the lever 240, which transmits the force of the elastic member 250, is directly in contact with the cam member 230, a structure such as a link structure disposed between the conventional slider corresponding to the cam member and the lever may be excluded from the configuration of the hinge unit 200.

Therefore, according to one embodiment, while excluding the link structure or the hydraulic cylinder, it is possible to profile a shape the contact section 233 to control a magnitude of a force applied to the lever 240 and control an opening and closing speed of the door 100, in order to generate an effect corresponding to an effect generated by the conventional configuration.

Figure 7:
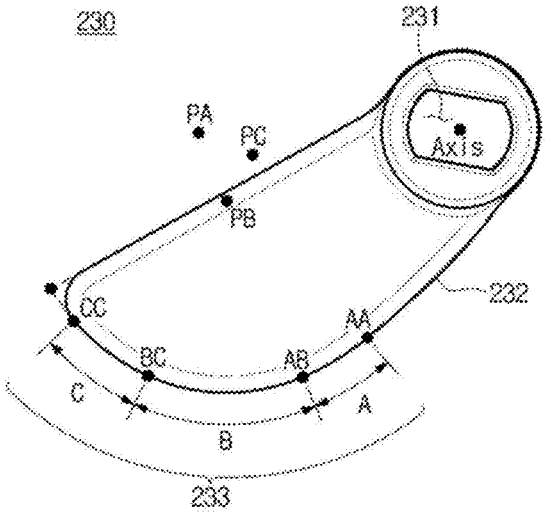
FIG. 7 is a view showing a cam member of the washing according to one embodiment of the present disclosure.

Particularly, as illustrated in FIG. 7, by setting a first section A, a second section C and a third section B having different curvatures on the contact section 233, the pressing portion 244 may be sequentially in contact with the first section A, the second section C and the third section B along the contact section 233 when the cam member 230 rotates in one direction (counterclockwise direction), (in the order of 2-3-1 section (C-B-A) when the cam member 230 rotates in the other direction), and thus a value of a force transmitted from the pressing section 244 may be controlled through the curvature set in each section.

When any one point or a range, which is on the contact section 233 and pressed by the pressing portion 244, is referred to as the contact portion 234, the contact portion 234 may be disposed between AA and CC due to the rotation of the cam member 230, and the contact portion 234 may be selectively disposed in one of the first section A and the second section C or the third section B according to the rotation of the cam member 230.

That is, as a configuration that is provided on the lever 240 and in contact with the cam member 230 to transmit the force of the elastic member 250 to the cam member 230, a portion where the pressing portion 244 is in contact with the cam member 230 may become the contact portion 234 of the cam member 230

The first section A, the second section C, and the third section B may be provided to include different curvatures. When assuming that the center of curvature of the first section A is PA, the center of curvature of the second section C is PB, and the center of curvature of the third section B is PB, as illustrated in FIG. 7, it can be seen that the centers of curvature are all arranged at different positions.

When the contact portions 234 are arranged in the respective sections A, B and C, since the sections A, B and C are formed with different curvatures, the direction of the force F1 transmitted by the pressing portion 244 may vary. Particularly, a curvature contained in the third section B may be greater than a curvature contained in the first section A or a curvature contained in the second section C. The curvature contained in the first section A may be less than the curvature contained in the second section C or the curvature contained in the third section B. This is an important factor for selecting the magnitude of the first torque T1, which will be described later.

Hereinafter a position in which the pressing portion 244 is in contact with the cam member 230 due to the rotation of the cam member 230 and a position of the contact portion 234 generated thereby when the door 100 is rotated from a fully opened state to the closing direction, will be described.

FIGS. 8A to 8D illustrate the cam member 230 and the lever 240 disposed according to the rotation of the door 100. However, for the convenience of description, except for the door 100, only the insertion portion 222 of the shaft 220 that is rotated to correspond with the door 100 is described.

Since an angle at which the insertion portion 222 is disposed is the same as an angle at which the door 100 is disposed, the angle at which the insertion portion 222 is disposed represents the angle at which the door 100 is disposed although the door 100 is not shown in FIGS. 8A to 8D.

Figure 8A:
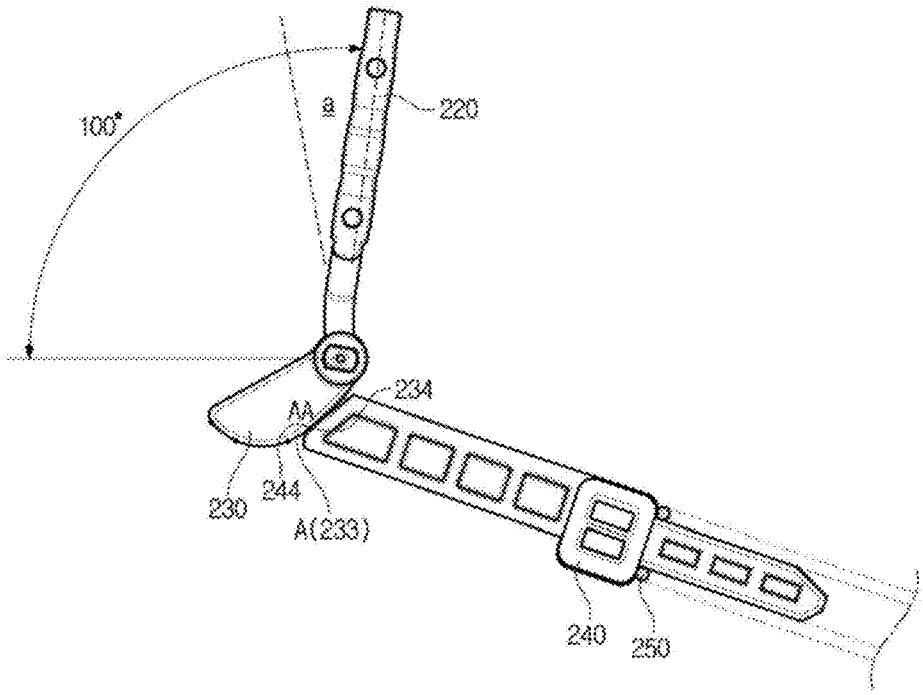
FIG. 8 is a schematic view showing a process of opening and closing the door of the washing machine according to one embodiment of the present disclosure.
Figure 8B:
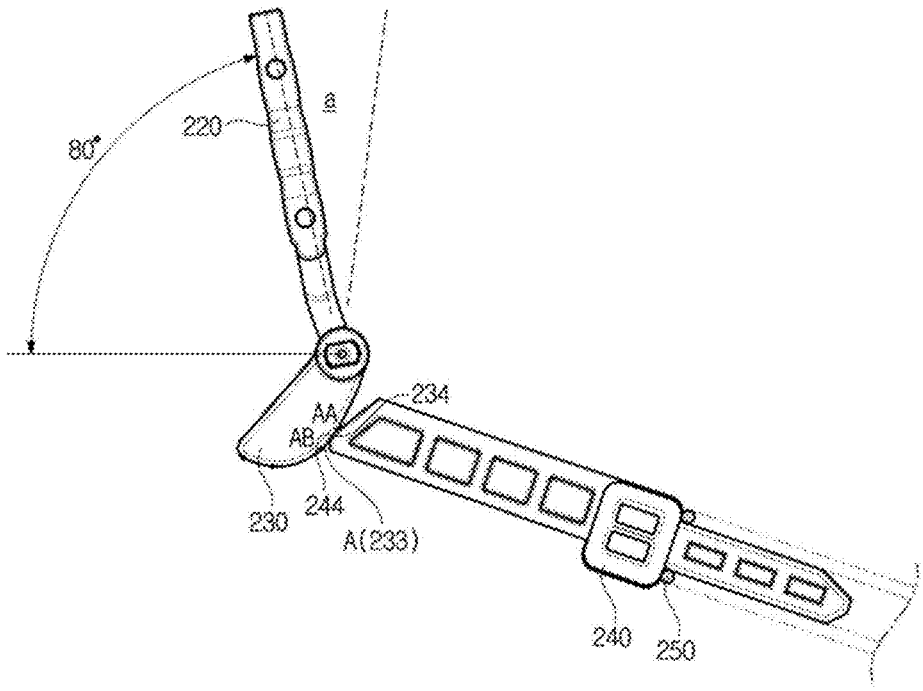

As illustrated in FIG. 8A, the door 100 may be placed in a fully open position when the contact portion 234 is located at an AA point on the contact section 233. In addition, the AA point is a point at which the first section A starts. As the door 100 is rotated in the closing direction, the cam member 230 may be rotated and the contact portion 234 in contact with the pressing section 244 is continuously positioned on the contact section 233 along the first section A, as illustrated in FIG. 8B.

When the pressing section 244 is in contact with the point AB and the contact section 234 is positioned at the point AB by the rotation of the cam member 230, the contact portion 234 passes the first section A and starts to be disposed on the third section B. The third section B is a section having a different curvature from the first section A, and the door 100 is moved to the closed position by the pressure of the user, which will be described later.

Figure 8C:
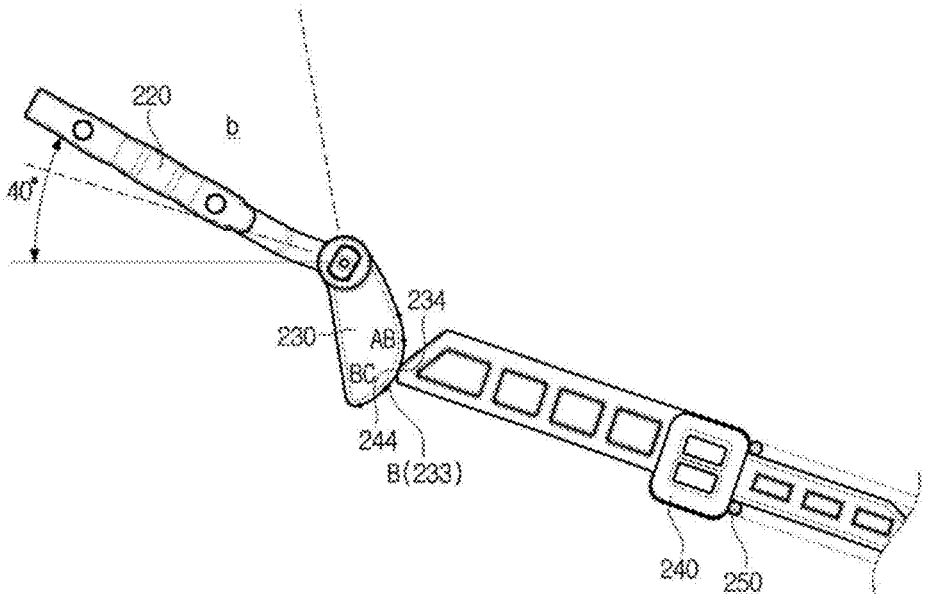

The pressing portion 244 may be in contact with and press the third section B due to the continuous rotation of the cam member 230 as shown in FIG. 8C, and when the third section B is ended, the pressing portion 244 may be in contact with a BC point in which the second section C is started. As the pressing section 244 is continuously in contact with the second section C along the third section B, the contact portion 234 may be also continuously disposed on the second section C along the third section B.

Figure 8D:
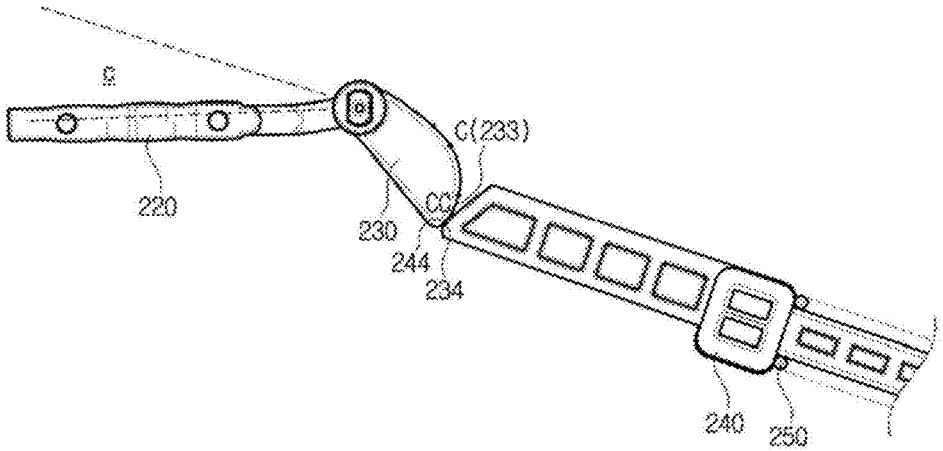

As illustrated in FIG. 8D, the pressing portion 244 may pass the BC point and continuously in contact with the second section C and then reach a CC point due to the rotation of the cam member 230. When the pressing portion 244 is in contact with the CC point, the door 100 may be placed in the fully closed position and thus the door 100 may be closed.

When the door 100 is rotated from the closed state to the open state, the pressing portion 244 may be arranged to be the fully open position while the pressing portion 244 is in contact with the contact section 233 contrary to the above-described procedure.

From the fully closed position, in which the angle about the opening 24 is 0 (zero) to close the opening 24, the door 100 may be rotated clockwise to allow the angle about the opening 24 to be increased from 0 (zero) degree so as to open the opening 24. Accordingly, the opening 24 may be fully opened when the angle about the opening 24 reaches 100 degrees. However, the full opening angle is not limited to one embodiment, and it may be formed at an angle lower than 100 degrees or an angle greater than 100 degrees.

When the door 100 is rotated clockwise to be disposed adjacent to the fully opened position as shown in FIGS. 8A and 8B, the door 100 may reach a first position (a). When the door 100 is disposed at the first position (a), the contact portion 234 may be disposed on the first section A.

When the door 100 is disposed at the first position (a), a resultant force of the torque applied to the cam member 230 may be formed in the direction of the first torque T1 and thus the cam member 230 may be rotated clockwise, which is the opening direction of the door 100, even if the user does not press the door 100 in the clockwise direction Particularly, the first torque T1 formed by the contact portion 234 disposed in the first section A may be applied to the cam member 230 stronger than the second torque T2, and thus the cam member 230 may be rotated clockwise and the door 100 may be automatically rotated from the position of FIG. 8B to the position of FIG. 8A without the user's pressure.

In addition, when the door 100 is disposed adjacent to the fully closed position since the door 100 is rotated counterclockwise as shown in FIG. 8D, the door 100 may reach the second position (c). When the door 100 is disposed at the second position (c), the resultant force of the torque applied to the cam member 230 may be formed in the direction of the second torque T2 and the cam member 230 may be rotated counterclockwise, which is the closing direction of the door 100, even if the user does not press the door 100 counterclockwise.

Particularly, the first torque T1 formed by the contact portion 234 disposed in the second section C may be applied to the cam member 230 more weakly than the second torque T2, and thus the cam member 230 may be rotated counterclockwise and when the door 100 is paced in the second position (c), the door 100 may be automatically rotated to the position of FIG. 8D without the user's pressure.

As shown in FIG. 8C, the door 100 may be rotated clockwise or counterclockwise and then disposed at a third position (b) provided between the first position (a) and the second position (c). At this time, the contact portion 234 is located on the third section B and includes a position in which the external resultant force applied to the cam member 230 becomes 0 (zero) when the door 100 is disposed at the third position (b), and thus the door 100 may be placed in a stop state on the third position (b) when the user does not press the door 100.

As for the contact section 233, the first section A, the section C and the third section B may be set to allow the door 100 to be disposed at the first position (a), the second position (c) and the third position (b), respectively. The contact section 233 may be profiled differently according to the section so that when the pressing portion 244 is in contact with the respective sections A, C, and B, the door 100 may be disposed at the respective position (a, c, and b).

That is, in the case of the second torque T2, since the self-weight of the door 100 does not change during rotation because the door 100 is formed by a predetermined material, the force (F2) value, which is generated by the gravity acceleration at the center of gravity G of the door 100, is always constant. Therefore, the second torque T2 changes according to the change in the vertical distance r2 of the center of gravity G from the rotation axis due to the rotation of the door 100. That is, the center of gravity G is not changed during the rotation of the door 100, and as the center of gravity G is constantly moved in the rotation direction of the door 100 according to the rotation of the door 100, the vertical distance r2 of the center of gravity G may be constantly changed, and thus the second torque T2 may have a substantially constant variation.

However, in the case of the first torque T1, the pressing portion 244 is brought into contact with a part of the contact section 233 by the force F1 formed by the elastic member 250. The magnitude of the first torque T1, which is generated as mentioned above, is changed according to the magnitude of the force F1 and the distance r1 in the direction perpendicular to the direction in which the force F1 is directed.

Particularly, the F1 value generating the first torque T1 may vary depending on the compressive force of the elastic member 250, and the degree of compression of the elastic member 250 may vary according to the rotation of the cam member 230, and thus the F1 value may be changed according to the degree of rotation of the cam member 230.

The direction of the F1 transmitted to the cam member 230 through the pressing portion 244 is changed by the curvature of the curved surface of the cam member 230. Therefore, the direction of the F1 may be changed depending on which section of the contact section 233 is in contact with the pressing portion 244, and thus the value of the distance r1 in the vertical direction with respect to the direction in which the F1 is directed may be changed.

In other words, since the direction of F1 is changed according to the curvature of the curved surface 232 on which the contact portion 234 is disposed, the value of r1 may vary depending on the curvature.

That is, the magnitude of the first torque T1 may be controlled by changing the curvature of the contact section 233, and thus the magnitude of the first torque T1 may be controlled through the profile of the curved surface 232 of the cam member 230. Therefore, through the profile of the cam member 230, it is possible to control the resultant torque applied to the cam member 230 by the first torque T and the second torque T2.

When the door 100 is disposed at the first position (a), the pressing portion 244 may be brought into contact with the first section A and the curvature of the first section A may be profiled to make the first torque T1 greater than the second torque T2, and thus the door 100 may be automatically rotated in the opening direction when the door 100 is disposed at the first position (a).

When the door 100 is disposed at the second position (c), the pressing portion 244 may be brought into contact with the second section C and the curvature of the second section C may be profiled to make the first torque T1 less than the second torque T2, and thus the door 100 may be automatically rotated in the closing direction when the door 100 is disposed at the second position (c).

When the door 100 is disposed at the third position (b), the pressing portion 244 may be brought into contact with the third section B and the curvature of the third section B may be profiled to include a section in which the external resultant force received by the cam member 230 is 0 (zero), and thus when the door 100 is disposed at the third position b, the door 100 may be maintained at the stop state when the user does not press in the opening direction or the closing direction.

Particularly, when the door 100 is disposed at the second position (c), the door 100 is automatically rotated in the closing direction. At this time, a safety accident in which the user's hand is caught between the door 100 and the cabinet 10 may occur.

In order to prevent this accident, the curvature of the second section C may be profiled such that the magnitude difference between the first torque T1 and the second torque T2 in the second section C is not significantly large.

That is, when the pressing portion 244 is adjacent to the BC point on the second section C along the third section B, the difference in the magnitude between the first torque T1 and the second torque T2 may be reduced, and thus the closing speed of the door 100 may be controlled to allow the door 100 to be slowly closed.

According to one embodiment, the first position (a) and the third position (b) of the door 100 may be divided based on when the door 100 is disposed between approximately 75 and 85 degrees. Therefore, when the door 100 is disposed between approximately 75 and 85 degrees while the door 100 is being opened, the door 100 may be rotated in a direction to open the door 100, and automatically rotated to a position where the door 100 is at 100 degrees.

In addition, the second position (c) and the third position (b) of the door 100 may be divided based on when the door 100 is disposed between approximately 25 and 35 degrees. Therefore, when the door 100 is disposed between approximately 25 and 35 degrees while the door 100 is being closed, the door 100 may be rotated in a direction to close the door 100, and automatically rotated to a position where the door 100 is at 0 degree.

When the door 100 is disposed between approximately 25 degrees and 85 degrees, which is the third position (b), the door 100 may be maintained in the stop state when no pressure is applied by the user of the door 100.

As described above, the first, second, and third positions (a, b, and c) at which the door 100 is disposed, may be changed according to which section of the contact section 233 of the cam member 230 is pressed by the pressing section 244, in other words, according to which section of the first section A, the second section C, or the third section B of the contact section 233 in which the contact portion 234 is disposed.

In addition, the first position (a) and a third position (b) of the door (100) is divided with respect to approximately 80 degrees, and the second position (c) is divided with respect to approximately 30 degrees. An angle at which the first, second, and third positions (a, b, c) of the cam member 100 are separated may be changed by the profile of the cam member 230. This will be described in detail with reference to the graph of FIG. 9.

Figure 9:
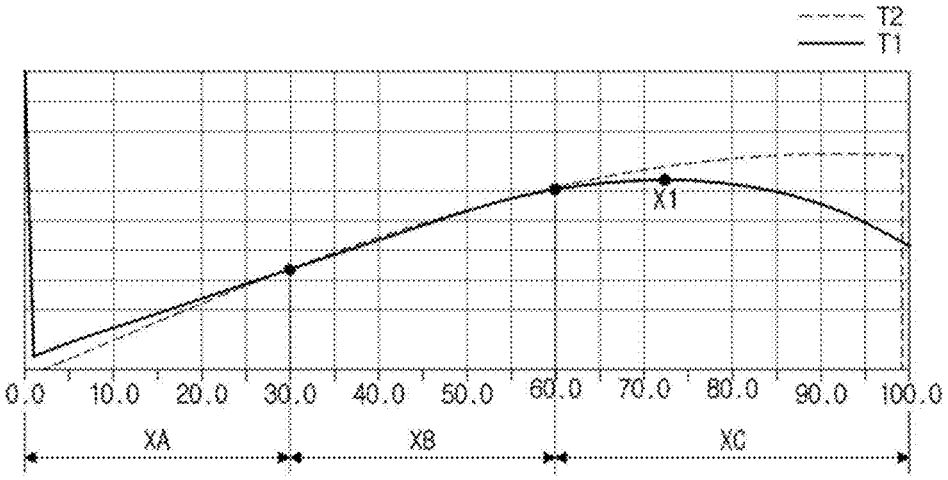
FIG. 9 is a general graph of a first torque and a second torque applied to the cam member of the washing machine according to one embodiment of the present disclosure.

In a graph of FIG. 9, a X axis is set to 0 (zero) when the door 100 is at 100 degrees at the fully open state, and the X axis is set to 100 when the door 100 is at 0 (zero) degrees at the fully closed state. That is, the direction from 0 to 100 on the x-axis is the direction in which the door 100 rotates from the fully open state to the closed state.

As shown in the graph, the change in the magnitude of the first torque T1 and the second torque T2 when the door 100 is rotated in the closing direction is that the second torque T2 continues to increase toward the closed position of the door 100, and the first torque T1 increases along with the rotation and then decreases by passing through a transition point X1 disposed in the second section C.

Conversely, as shown in the graph, the change in the magnitude of the first torque T1 and the second torque T2 when the door 100 is rotated in the opening direction is that the second torque T2 continues to decrease toward the open position of the door 100, and upon closing, the first torque T1 increases along with the rotation and then decreases by passing through the transition point X1 disposed in the second section C Accordingly, on the graph, the section is divided into a section XA in which the first torque T1 is greater than the second torque T2, a section XB in which the first and second torques T1 and T2 correspond to each other, and a section XC in which the first torque T1 is less than the second torque T2.

As described above, on the graph, the section XA in which the first torque T1 is greater than the second torque T2 is a section in which the contact section 244 is disposed on the first section A, the section XB in which the first and second torques T1 and T2 correspond to each other is a section in which the contact section 244 is disposed on the third section B, and the section XC in which the first torque T1 is less than the second torque T2 is a section in which the contact section 244 is disposed on the second section C.

In addition, in the section XA in which the first torque T1 is greater than the second torque T2, the door 100 may be disposed on the first position (a). In the section XB in which the first and second torques T1 and T2 correspond to each other, the door 100 may be disposed on the third position (b). In the section XC in which the first torque T1 is less than the second torque T2, the door 100 may be disposed on the second position (c).

As mentioned above, since the magnitude of the first torque T1 and the second torque T2 is controlled through the profile of the cam member 230, the cam member 230 may be profiled to obtain a graph value that is the same as FIG. 9. That is, during the cam member 230 is rotated, the cam member 230 may be profiled to generate a graph including the XA section, the XB section, and the XC section.

When the cam member 230 is profiled to obtain the graph shown in FIG. 9, the angle of the door 100 for partitioning the XA section, the XB section, and the XC section may be arbitrary, which is changed according to the profile of the cam member 230.

That is, the curvature of the contact section 233 may be profiled to arbitrarily set the angle of the door 100 for dividing the positions a, b, and c. Therefore, the angle dividing the first position (a) and the third position (b) may be set to an angle other than 80 degrees, and the angle dividing the second position (c) and the third position (b) may be set to an angle other than 30 degrees.

The curvature of the sections A, B, and C of the contact section 233 of the cam member 230 may be profiled by considering the self-weight of the door 100, the elastic force of the elastic member 250, and the frictional force with each component, which are a factor for dividing the first position (a), the second position (c), and the third position (b) of the door 100.

Since the angle for dividing the first position (a), the second position (c), and the third position (b) of the door 100 is changed by the profiling of the cam member 230, a position of a point at which a graph of the first torque T1 and the second torque T2 are in contact with each other, may be changed. However, the cam member 230 may be profiled to allow the relative magnitudes of the first torque T1 and the second torque T2 to be maintained similar to the graph shown in FIG. 9.

Hereinafter a contact section 233' of a cam member 230 according to another embodiment of the present disclosure will be described. A construction, other than the contact section 230' described below, is the same as that of the washing machine 1 according to the above-described embodiment, and redundant description will be omitted.

Figure 10:
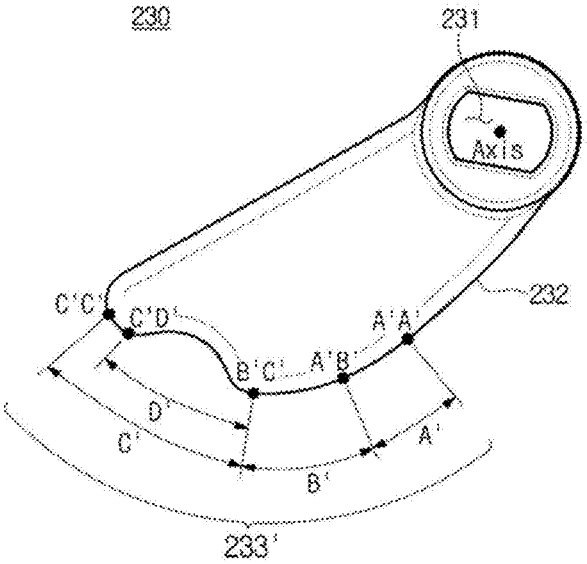
FIG. 10 is a view showing a cam member of a washing machine according to another embodiment of the present disclosure.

As shown in FIG. 10, a second section C' of the contact section 233' according to another embodiment may include a fourth section D'. The fourth section D' may be concave relative to a curved surface 232.

When the contact portion 234 is disposed in the second section C, the door 100 is rotated in the closing direction. As shown in FIG. 9, as the door 100 is rotated in the closing direction, the difference in magnitude of the first torque T1 and the second torque T2 gradually increases and the rotational speed in the closing direction becomes larger.

That is, the angle of the door 100, at which the second section C starts, is approximately 30 degrees. This is because the door 100 is rotated more rapidly as the door 100 is disposed at an angle lower than 30 degrees. It is to prevent a safety accident in which the user's finger is caught in the door 100 when the door 100 is closed.

However, in practical, the angle of the door 100, at which the user's finger may be caught by the door 100, may be about 10 degrees which is very close to the closing position of the door 100.

In a section from 10 degrees to 30 degrees, at which the user's fingers is not caught, among the section in which the angle of the door 100 is equal to or less than 30 degrees, it may be not required that the door 100 is rotated slowly ("slowly" represents a speed in which the door is rotated according to one embodiment)

Therefore, the fourth section D' may be provided on the cam member 230 according to another embodiment, wherein the fourth section D' is profiled to allow the door 100 to quickly rotated ("quickly" represents a speed in which the door is rotated according to one embodiment) when the contact portion 234 is disposed in a part of the second section C'.

Figure 11A:
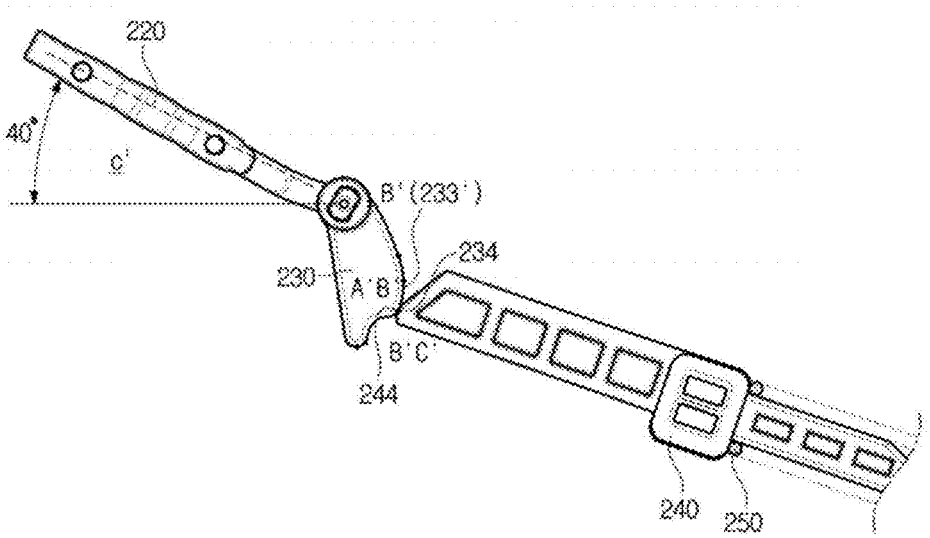
FIG. 11 is a schematic view showing a process of opening and closing a door of the washing machine according to another embodiment of the present disclosure.
Figure 11B:
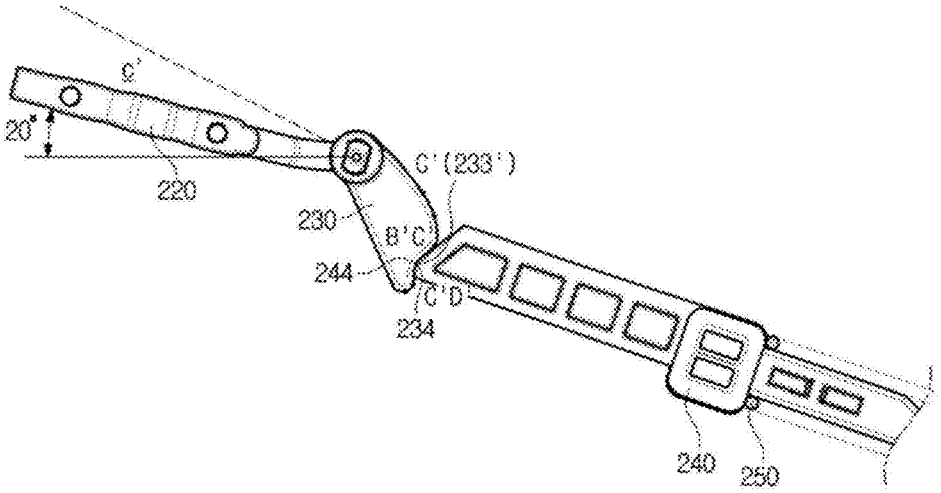

Particularly, the fourth section D' may be contained on the second section C'. When the contact portion 234 reaches the fourth section D' concaved on the second section C' as shown in FIG. 11B, the force that the cam member 230 pushes the lever 240 may be suddenly changed, particularly, as compared with the second section C' (FIG. 11C) or the third section B' (FIG. 11A), a force of pushing the lever 240 may be reduced and a force of compressing the elastic member 250 may be reduced. Accordingly, a force that the pressing portion 244 elastically supports the cam member 230 is reduced and thus the magnitude of the first torque T1 may be reduced.

Therefore, in a state in which the contact portion 234 is disposed on the fourth section D', when the door 100 is rotated in the closing direction, the difference in the magnitude between the second torque T2 and the first torque T1 may significantly occur ("significantly" represents the difference in magnitude between the second torque T2 and the first torque T1 generated when the door 100 is rotated in the closing direction in a state in which the contact portion 234 according to one embodiment is disposed on the second section C).

Figure 11C:
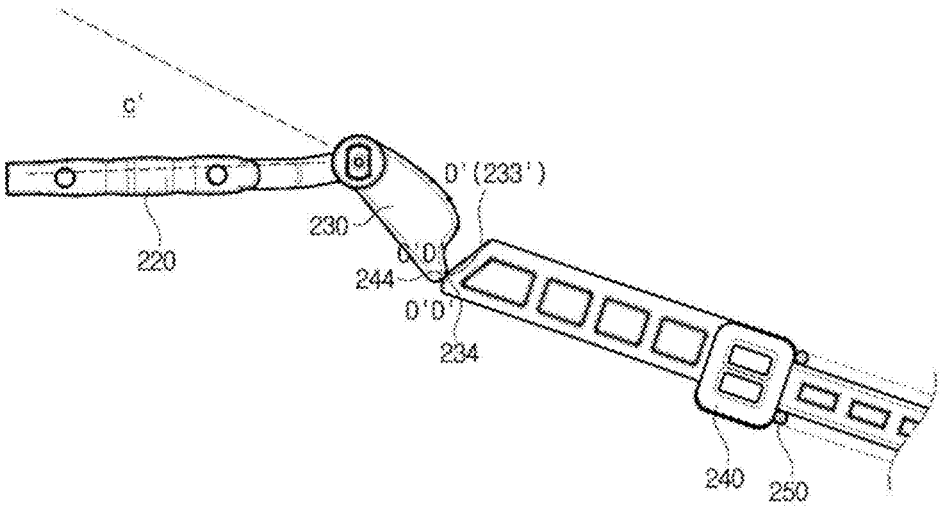

When the contact portion 234 is disposed in the second section B' by passing the fourth section D' as shown in FIG. 11C, during the door 100 is continuously rotated in the closing direction, the magnitude of the first torque T1 may be increased and thus the rotation speed of the door 100 may be reduced.

Figure 12:
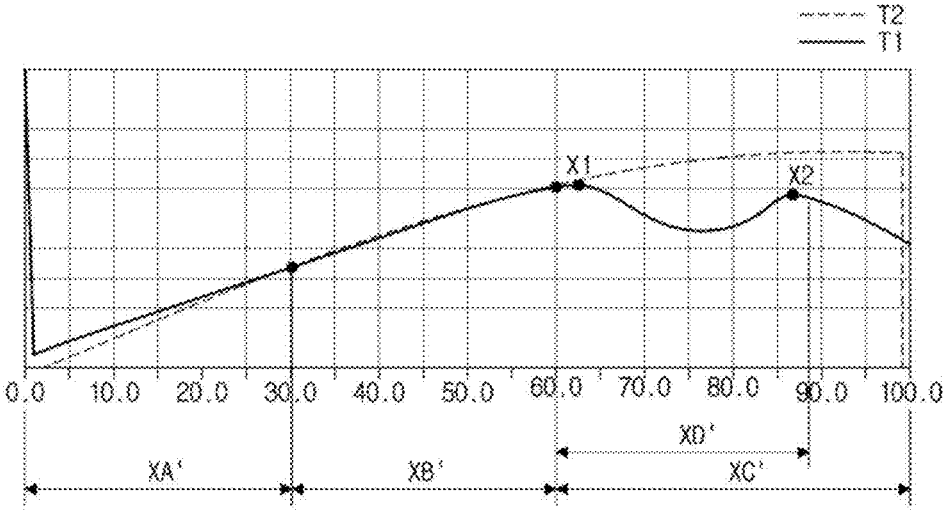
FIG. 12 is a general graph of a first torque and a second torque applied to the cam member of the washing machine according to another embodiment of the present disclosure.

This can be confirmed based on the graph shown in FIG. 12. When the contact portion 234 is disposed in the first section A and the third section B, a graph may form sections XA' and XB'. When the door 100 is arranged at an angle corresponding to the section of XA 'and XB', the door 100 may be rotated similarly to the graph of FIG. 9 according to the above-described embodiment.

However, when the contact portion 234 is disposed on the second section C', the graph according to another embodiment has a section XD' within a section XC' while the door 100 is rotated in the closing direction. As illustrated in FIG. 12, the XD' section is a section in which the difference between the magnitude of the first torque T1 and the second torque T2 is large. Accordingly, when the door 100 is disposed from 10 degrees to 30 degrees corresponding to the XD', the door 100 may be rotated rapidly in the closing direction.

The contact portion 234 may be disposed in the second section B' when the door 100 is continuously rotated in the closing direction, and thus the first torque T1 may be temporarily increased. Accordingly, the rotational speed of the door 100 may be slower than when the contact portion 234 is disposed on the fourth section D'.

That is, the section XC' except for the section XD' on the graph corresponds to a case in which the door 100 has an angle between 0 to 10 degrees. When the door 100 is disposed at an approximately 10 degrees since a section is changed from the section XD' to the section XC' and thus the magnitude of the first torque T1 is increased, the door 100 may be rotated slower than when the door 100 is disposed at 10 to 30 degrees, and thus it may be possible to prevent the safety accident in which the user's fingers are caught in the door 100.

The door 100 is further rotated in the closing direction and thus the magnitude of the first torque T1 is reduced. Accordingly, the door 100 may be rapidly rotated and thus the door 100 may be fully closed.

Unlike another embodiment, the fourth section D' may also be formed in a shape protruding convexly with respect to the curved surface 322. When the fourth section D' is convex, the first torque T1 may be larger and the rotational speed of the door 100 may be slower.

As needed, it may be possible to profile the fourth section D' of the cam member 230 so as to rotate the door 100 faster or slower. In addition, as well as the fourth section D', a fifth section configured to control the magnitude of the first torque T1 and the second torque T2 may be provided on the contact section 233 so as to control the rotation speed and the direction of the rotation of the door 100.

That is, it is possible to freely control the rotation speed and the direction of the rotation of the door 100 by variously profiling the shape of the contact section 233 of the cam member 230. Accordingly, it is possible to easily control the door 100 by using only the cam member 230, the lever 240 directly in contact with the cam member 230, and the elastic member 250 elastically support the lever 240.

Hereinafter, a hinge unit 200' according to another embodiment will be described. A configuration, other than a lever 240' or a damper 260 described below, is the same as that of the washing machine 1 according to one embodiment described above, and redundant description will be omitted.

Figure 13:
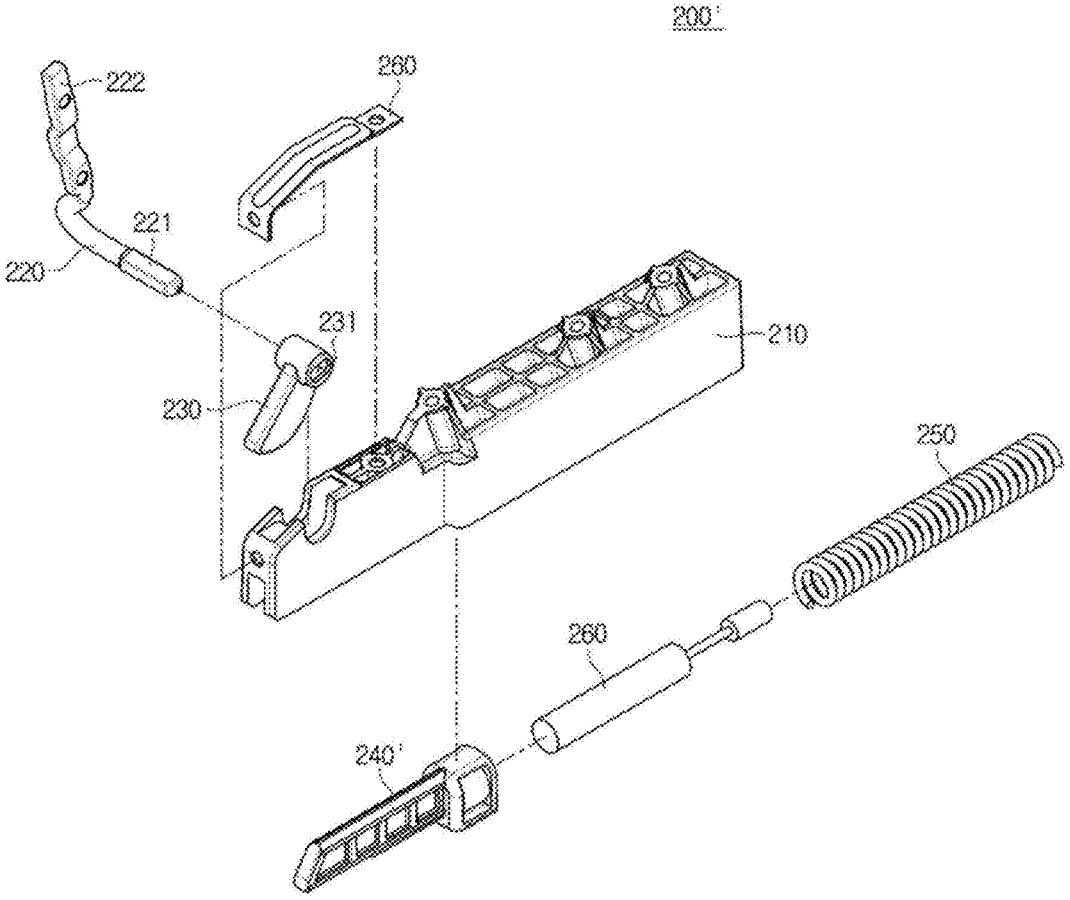
FIG. 13 is an exploded perspective view of a hinge unit of a washing machine according to another embodiment of the present disclosure.
Figure 14:
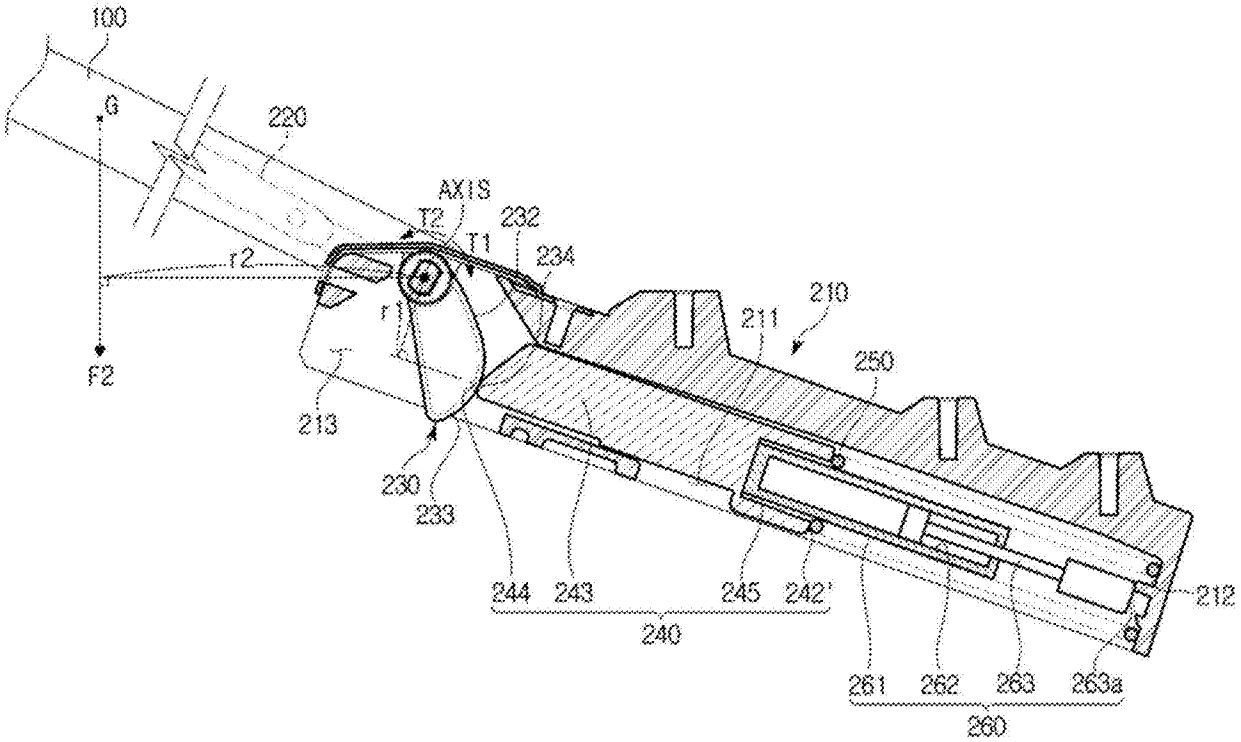
FIG. 14 is a schematic side cross-sectional view of the hinge unit of the washing machine according to another embodiment of the present disclosure.

As illustrated in FIGS. 13 and 14, the hinge unit 200' may further include the damper 260, unlike the hinge unit 200 according to an embodiment.

The damper 260 may be disposed on one side of the lever 240'. Particularly, the damper 260 may be inserted into an insertion groove 245 provided at one side of the hinge unit 200' and inserted into an elastic member 250 while being disposed at one side of the lever 240'.

The lever 240 according to one embodiment is provided with the guide portion 241, but the lever 240' according to another embodiment has the damper 260 may be provided on a position on which the guide portion 241 is supposed to be placed.

A support 242' may be provided on an edge of the insertion groove 245 and thus the elastic member 250 may be supported by the support 242' to transmit an elastic force to the lever 240'. Since the damper 260 is inserted into the elastic member 250 while the elastic member 250 is supported by the support 242', the damper 260 may guide the elastic member 250 to allow the elastic member 250 to be compressed and extended without being separated from the lever 240'.

The damper 260 may include a damper housing 261 and a cylinder chamber 262 provided inside of the damper housing 261, and a rod 263 configured to reciprocate within the cylinder chamber 262. In the cylinder chamber 262, oil provided to restrict the reciprocation of the rod 263, an orifice through which the oil is moved, and an air chamber are additionally contained. However, for convenience of description, those are not shown in drawings.

When the lever 240' is linearly moved toward the support surface 212 of the housing 210 by the cam member 230 rotated according to the door 100 when the door 100 is closed, the damper 260 may perform damping to attenuate the speed of the linear motion of the lever 240' toward the support surface 212 side.

That is, as described above, it is possible to set the torque values T1 and T2 by profiling the curved surface 232 of the cam member 230 so as to prevent the user's finger from being caught between the door 100 and the cabinet 10 upon closing the door 100. In addition, it is possible to more prevent the safety accident by additionally reducing the closing speed of the door 100 by adding the damper 260. In addition, when the door 100 finally closes the opening 24 of the cabinet 10, a user may stably and smoothly close the door 100 since the closing speed of the door 100 is naturally reduced by the damper 260.

Figure 15A:
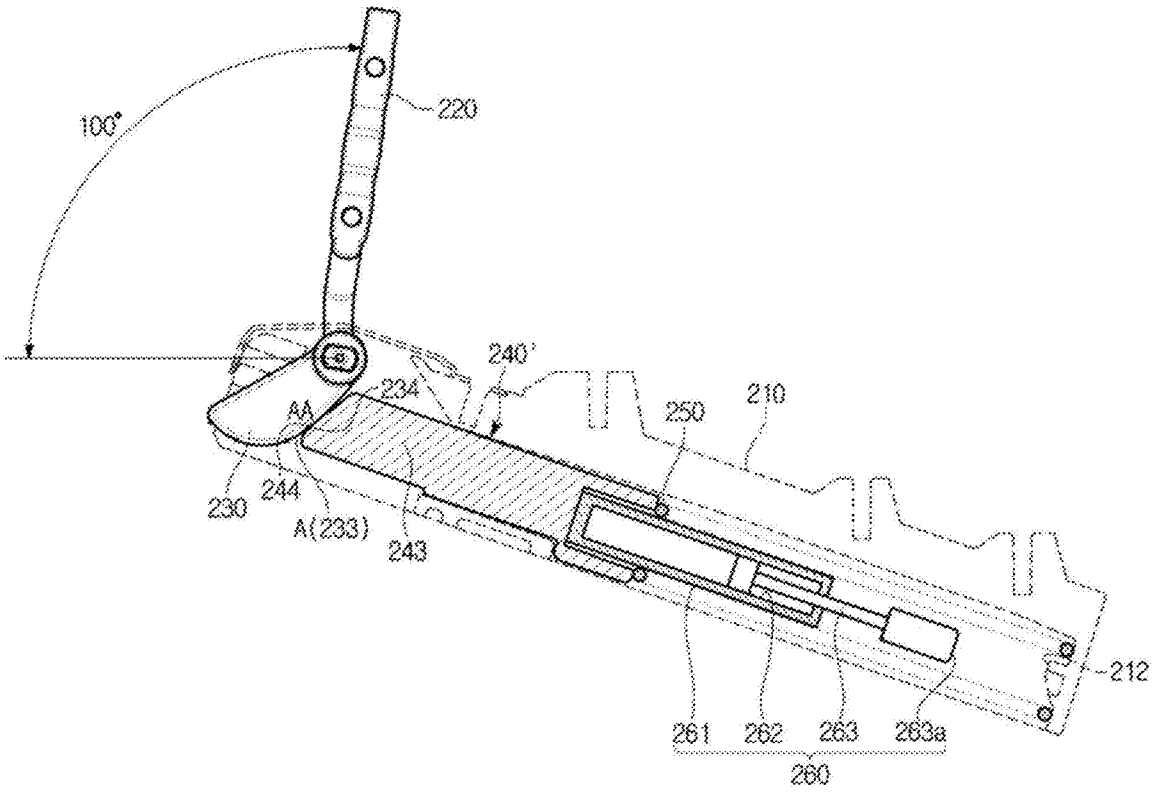
FIG. 15 is a view showing a process of opening and closing a door of the washing machine according to another embodiment of the present disclosure.
Figure 15B:
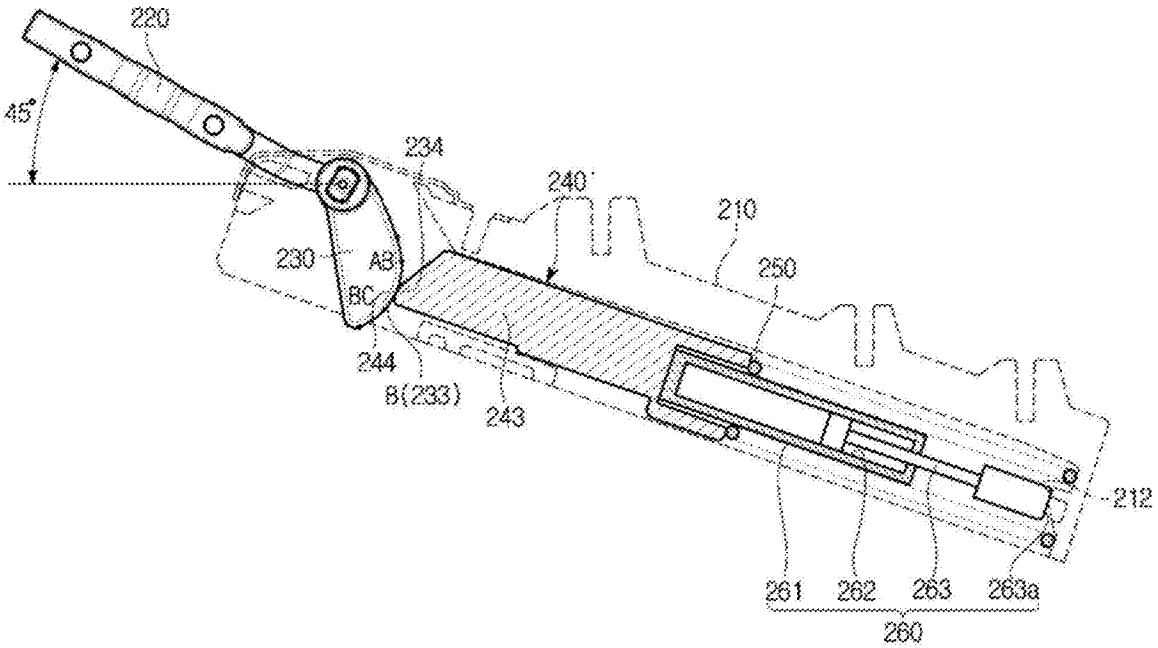
Figure 15C:
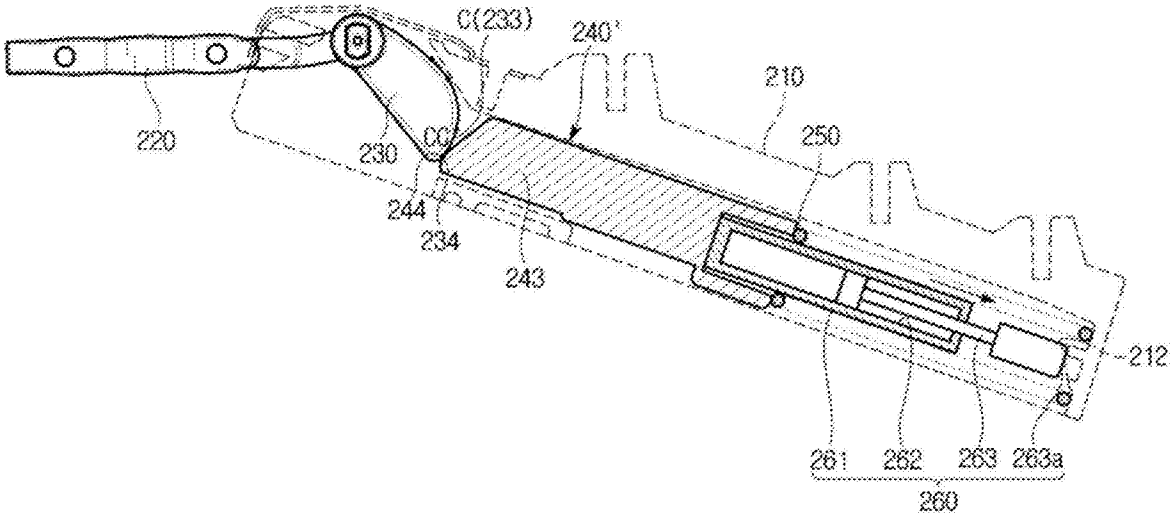

Particularly, as illustrated in FIG. 15A, when the pressing portion 244 of the lever 240' is in contact with the first section A, the damper 260 does not perform damping since the damper 260 is not in contact with the support surface of the housing 210. That is, when the pressing portion 244 is in contact with the first section A, the door 100 may be placed in the door opening section and thus the rotation of the door 100 may be not restricted by the damper 260.

When the door 100 is rotated in the door closing direction in the open state, a point, at which the pressing member 244 is in contact with the cam member 230, is sequentially moved from the first section A to the third section B and the second section C as the cam member 230 rotates in conjunction with the door 100.

During the pressing portion 244 is in contact with any one point of the third section B (when the opening angle of the door 100 is about between 45 and 100 degrees), when the door 100 is further rotated in the door closing direction and thus the opening angle of the door 100 is reduced, the curved surface 232 may press the lever 240' by the cam member 230 rotated and thus the lever 240' may be further moved toward the support surface 212 side.

Accordingly, the rod 263 of the damper 260 is in contact with one side of the housing 210, and as a contact surface 263*a* of the rod 263 is in contact with the support surface 212 of the housing 210, damping may occur to prevent the lever 240' from moving to the support surface 212 side.

The opening angle of the door 100 may be about 45 degrees when the contact surface 263*a* of the rod 263 and the support surface 212 are in contact with each other, but the opening angle is not limited thereto. The opening angle of the door 100, when the contact surface 263*a* and the support surface 212 are in contact with each other, may vary according to the size of the door 100 or the elastic force of the elastic member 250.

When the door 100 is rotated in the closing direction after the contact surface 263*a* and the support surface 212 are in contact with each other, the translational motion of the lever 240' may be limited by the damper 260, and thus the door 100 may be rotated relatively slow.

That is, when the door 100 is rotated in the closing direction while the contact surface 263*a* is in contact with the support surface 212 of the rod 263 as shown in 15C, the rod 263 may perform the linear motion inside the lever 240 and damping may occur with respect to the lever 240'.

Therefore, when the door 100 is rotated in the closing direction in the state where the opening angle of the door 100 is 45 degrees or less, damping of the damper 260 may occur and the closing speed of the door 100 may be reduced.

The lever 240 according to one embodiment may adjust the first torque T1 value by being in contact with the first section A, the second section C, and the third section B having a different curvature. However, according to another embodiment, the first torque T1 value formed on the door 100 by the lever 240' may be formed differently from the first torque T1 value according to one embodiment, since the damper 260 is disposed.

That is, according to one embodiment, a point where the first torque T1 and the second torque T2 have the same value is formed in the third section B, and thus the door 100 may be maintained in the stopped state. However, according to another embodiment, a point where the first torque T1 and the second torque T2 have the same value 260 may be formed in the second section C instead of the third section B, due to the damping of the damper 260.

According to one embodiment, the point at which the first torque T1 and the second torque T2 have the same value may be maintained in a predetermined section. However, according to another embodiment, the point at which the first torque T1 and the second torque T2 have the same value may be not maintained in a predetermined section, but may be formed as a single point.

Figure 16:
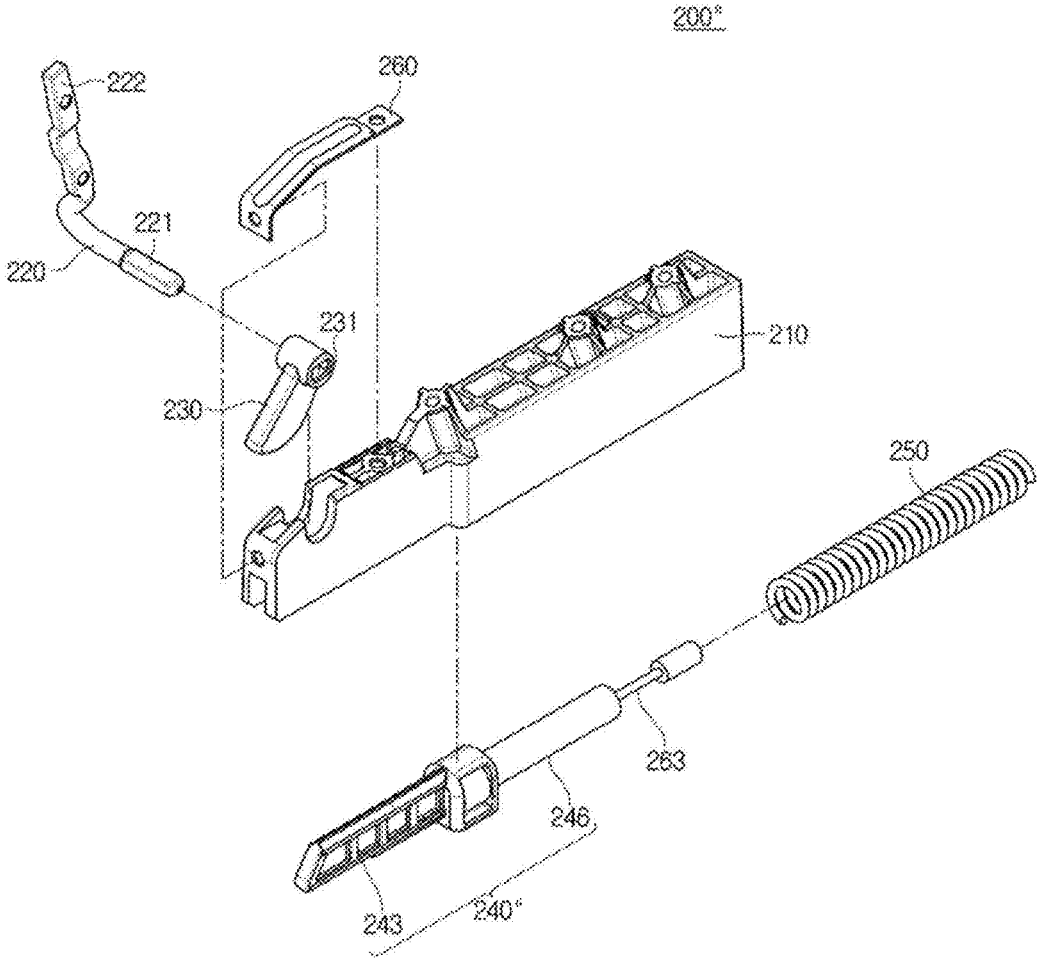
FIG. 16 is an exploded perspective view of a hinge unit of a washing machine according to another embodiment of the present disclosure.
Figure 17:
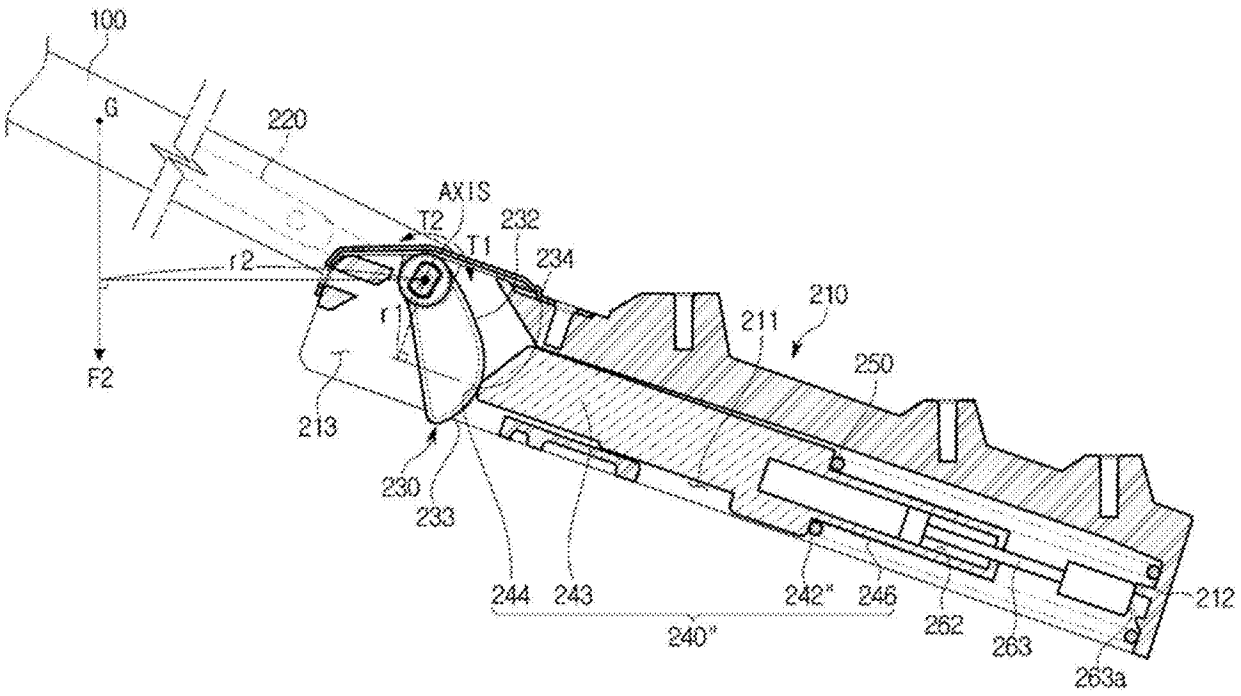
FIG. 17 is a schematic side cross-sectional view of the hinge unit of the washing machine according to another embodiment of the present disclosure

Hereinafter a hinge unit 200" according to another embodiment will be described. A configuration, other than a lever 240" described below, is the same as that of the washing machine 1 according to one embodiment described above, and redundant description will be omitted As illustrated in FIGS. 16 and 17, the lever 240" may include a lever body 243 and a damper portion 246 extending from one side of the lever body 243. The damper portion 246 may be provided in a cylindrical shape having a hollow.

The hinge unit 200" may further include a cylinder chamber 262 provided in the hollow of the damper portion 246, and a rod 263 configured to reciprocate within the cylinder chamber 262. As the same as the above mentioned embodiment, when the lever 240" is linearly moved toward the support surface 212 of the housing 210 by the cam member 230, damping may occur while the contact surface 263*a* of the rod 263 is in contact with the support surface 212.

Practically, it can be seen that the damper portion 246 of the lever 240" corresponds to the damper housing 261 according to the above described—another embodiment. Accordingly, the damper portion 246 and the cylinder chamber 262 and the rod 263 inserted into the cylinder chamber 262 may correspond to the damper configuration. That is, it may be defined that the damper 260 disclosed in another embodiment is formed integrally with the lever 240" according to another embodiment. Particularly, the configuration of the damper housing 261 disclosed in the above mentioned another embodiment may be integrally formed with the lever 240" according to another embodiment.

While the present disclosure has been particularly described with reference to exemplary embodiments, it should be understood by those of skilled in the art that various changes in form and details may be made without departing from the spirit and scope of the present disclosure.

The invention claimed is:

1. A washing machine comprising:

a cabinet;

a door configured to be rotatable about the cabinet and configured to open or close one side of the cabinet;

a cam member configured to be rotated by the door and including a curved surface comprising a first section, a second section and a third section disposed between the first section and the second section, having curvatures different from each other;

a lever configured to press the cam member by being in contact with the curved surface of the cam member; and an elastic member configured to elastically support the lever, wherein a curvature contained in the first section is less than a curvature contained in the second section or a curvature contained in the third section.

2. The washing machine according to claim 1, wherein the door is rotated in a direction, in which the door is opened, when the lever comes into contact with the first section.

3. The washing machine according to claim 1, wherein the door is rotated in a direction, in which the door is closed, when the lever comes into contact with the second section.

4. The washing machine according to claim 1, wherein the door is in a stationary state when the lever comes into contact with the third section.

5. The washing machine according to claim 1, wherein the door has an opening angle of 0 (zero) degree when the door is in a closed state, and has an opening angle of 75 to 100 degrees when the lever comes into contact with the first section.

6. The washing machine according to claim 1, wherein the door has an opening angle of 0 (zero) degrees when the door is in a closed state, and has an opening angle of 0 to 35 degrees when the lever comes into contacted with the second section.

7. The washing machine according to claim 1, wherein the door has an opening angle of 0 (zero) degrees when the door is in a closed state, and has an opening angle of 25 to 85 degrees when the lever comes into contact with the third section.

8. The washing machine according to claim 1, further comprising:

a housing comprising a shaft inserted into the door to form a rotation axis of the door and coupled to the cam member, and an inner space in which the cam member, the lever and the elastic member are placed, wherein the elastic member is elastically deformed between one side of the inside of the housing and one side of the lever, and the lever is linearly moved inside of the housing by the elastic member and directly presses the cam member by the linear movement.

9. The washing machine according to claim 8, further comprising:

a damper disposed on one side of the lever and inserted into the inside of the elastic member.

10. The washing machine according to claim 9, wherein the damper comes into contact with one side of the housing when the lever is in contact with the third section, and the damper damps the linear movement of the lever by being in contact with one side of the housing when the lever is sequentially in contact with the third section and the second section due to a rotation of the cam member.

11. The washing machine according to claim 9, wherein the damper comprises a damper housing, a cylinder provided inside of the damper housing, and a rod configured to perform a transitional motion inside of the cylinder, wherein the damper housing is integrally formed with the lever.

12. The washing machine according to claim 1, wherein a curvature of the third section is greater than a curvature of the first section or a curvature of the second section.

13. The washing machine according to claim 1, wherein the third section comprises a fourth section concave in a direction toward a rotation axis of the cam member.

14. The washing machine according to claim 1, wherein when an angle, at which the door closes the cabinet, is 0 (zero), the cam member is profiled such that a distance between a rotation axis of the cam member and a contact portion of the cam member in contact with the lever becomes shorter as an opening angle of the door becomes larger.

* * * * *